United States Patent [19]

Velosa

[11] 4,105,899

[45] Aug. 8, 1978

[54] SAFETY MAT SWITCH FOR MACHINE TOOLS AND THEIR LIKE

[76] Inventor: Joseph M. Velosa, 515 N. Lone Hill, San Dimas, Calif. 91773

[21] Appl. No.: 758,508

[22] Filed: Jan. 12, 1977

[51] Int. Cl.[2] ..... H01H 3/14

[52] U.S. Cl. ..... 307/115; 200/86.5; 307/326; 340/573; 340/666

[58] Field of Search ..... 307/112, 113, 114, 115; 200/85 R, 85 A, 86 R, 86 A, 86.5, DIG. 35; 74/613, 616; 192/133, 137, 127, 129 R, 129 A, 142 R; 361/179, 1, 170; 340/272, 419

[56] References Cited

U.S. PATENT DOCUMENTS 2,644,868 7/1953 Locey ..... 200/86.5

*Primary Examiner*—James R. Scott
*Assistant Examiner*—Morris Ginsburg
*Attorney, Agent, or Firm*—Boniard I. Brown

[57] ABSTRACT

A safety switch for machine tools and their like is formed by a mat incorporating, normally open, switching elements responsive to the weight of a person standing on the mat. The presence of a specified load, commonly of the order of 50 pounds, on the mat causes the normally open switching elements therein to close and to establish an electrical circuit. This circuit is interconnected with the machine tool by means of a flexible cable and a twist-lock connector mating with an appropriate socket on the machine. The electrical circuit is made part of the normal machine motor control circuit in such a manner that the mat has to experience the load represented by the weight of the operator to allow the machine to start and to function. Removal of such load, as, for example, by the operator walking away from the machine, opens the motor control circuit and shuts the machine down.

8 Claims, 3 Drawing Figures

SAFETY MAT SWITCH FOR MACHINE TOOLS AND THEIR LIKE

BACKGROUND OF THE INVENTION

The invention relates to safety switches for machine tools and their analogues. It relates, more particularly, to safety switches employing a weight-sensitive mat with integral switching elements in the machine control circuit.

The art of providing safety switches for machine tools and other potentially dangerous devices is old. Many devices have been proposed in which the operator is required to use both hands to activate the machine process, or in which the presence of the operator, a part of his body, in a given position triggers a light beam/-photocell device to prevent machine operation, and so on. All of these safety devices are concerned with two primary causes of industrial accidents, the entrapment of the operator in the machine, and the use of the machine by those unskilled in the safe use thereof, and attempt to prevent the former contingency arising by providing some physical barrier or alarm system between the operator and the danger points on the machine, and the latter by requiring the use of keys or specific operating sequences or codes to cause the machine to perform its operating cycle.

These devices of the prior art are not generally applicable to machine tools in which the machine process is continuous and danger commonly arises not from the process itself but from some extraneous condition, such as the entanglement of the operator's clothing in the workpiece or tool, against which precautions cannot be readily taken. Commonly such machines as drill presses, milling machines, lathes, etc., are not provided with any safety device other than the start/stop switch, and rely on the agility and skill of the operator to press the stop switch before the accident sequence has reached a danger point, a very low level of protection for the operator.

It is, therefore, a primary object of the invention to provide a safety switch for the operator of a machine tool, or its like, incorporating a load-sensitive mat with electrical switching elements, which may be used to terminate machine operation without the use of his hands.

It is also an object of the invention to provide such a safety switch, and associated electrical circuitry, which is readily adapted to conventional machine tool control systems and requires no modification of the basic machine tool.

It is yet another object of the invention to provide a safety device for machine tools which is simple in construction, failsafe in operation, and convenient in use.

It is also the object of the invention to provide quick disconnect means for a mat safety switch as described hereinabove, whereby the removal of the safety switch from the machine circuit will cause the latter to be disabled and inoperative.

SUMMARY OF THE INVENTION

The invention attains the above objects, and other objects and advantages which shall become apparent from the detailed description of the preferred embodiment thereof below, by using a mat switch sensitive to the weight of an operator as the primary safety switch.

Mat switches are known in the art and are commonly utilized as sensors in automatic door operating devices and their like. Such mat switches are often provided with 'normally open' switching contacts, and establish an electrical circuit when subjected to a concentrated load corresponding to the weight of a human being supported on his foot. Typical specifications for such mat switches will call for a contact closure to be effected by a concentrated load of approximately 50 pounds over an area of several square inches, so that the switch will not respond to the passing thereover of a small child, for example.

The size of such mat switches varies considerably, depending on the intended final use; for the purposes of the instant invention a switch mat whose outlines correspond to the floor area normally occupied by a machine tool operator is required. Typically a rectangular mat switch is utilized with a measurement of approximately 2 feet along the longer side. With such a mat placed in the normal work position in front of a machine tool, the operator can comfortably perform his work while maintaining at least one foot on the mat switch continuously. In the event of an untoward happening, such as the entrainment of his necktie by the machine spindle, the operator can secure the cessation of machine motion by removing his weight from the mat. As soon as he steps off the mat surface the internal switching contacts open and signal the machine controls that the motor is to be shut down.

The current supply to the machine tool drive motor, or motors, is arranged to be controlled by means of a relay or magnetic starter, as is commonly the case. The operating coil of the relay is, in turn, powered through two switch circuits, one encompassing the normal starting switch of the machine, and the other, controlling the current to the other pole of the relay coil, passing through the mat switch itself, or through a secondary relay controlled by the mat switch. In this manner the removal of the load of the operator's weight from the mat switch will cause the relay contacts carrying the drive motor current to open, and the machine will stop.

The use of a secondary relay associated with the mat switch is desirable, so that the mat may be exposed to a reduced potential, 24 volts for example, so that accidental damage to the mat, resulting in an exposure of and contact with the conductors within will not result in an electrical shock hazard.

The safety switch is connected to the machine tool controlled by it through a flexible cable. The interface between the cable and the machine tool is preferably through a quick-disconnent device, so that the mat switch may be readily detached from the machine tool proper. With the safety switch removed from the energizing path to the main power relay the power supply circuit is broken, so that the machine cannot be started or operated by means of its normal controls. Under such circumstances the safety switch mat connector may be used as a disabling device when, for example, a repairman or setupman is working on the machine. Accidental contact with the start switch will not result in any actuation of the machine and will, therefore, present no danger to the repairman or to the machine itself.

The safety switch of the invention employs conventional components and techniques for its assembly and operation, and is readily retrofitted to machine tools constructed without safety devices. It is also adapted to be added to machine tools provided with safety devices of a different nature, without interfering with the operation of such device.

BRIEF DESCRIPTION OF THE ACCOMPANYING DRAWING

The preferred embodiment of the invention is described below with reference to the accompanying drawing, in which.

DESCRIPTION OF THE PREFERRED EMBODIMENT

Figures 1, 2, 3:
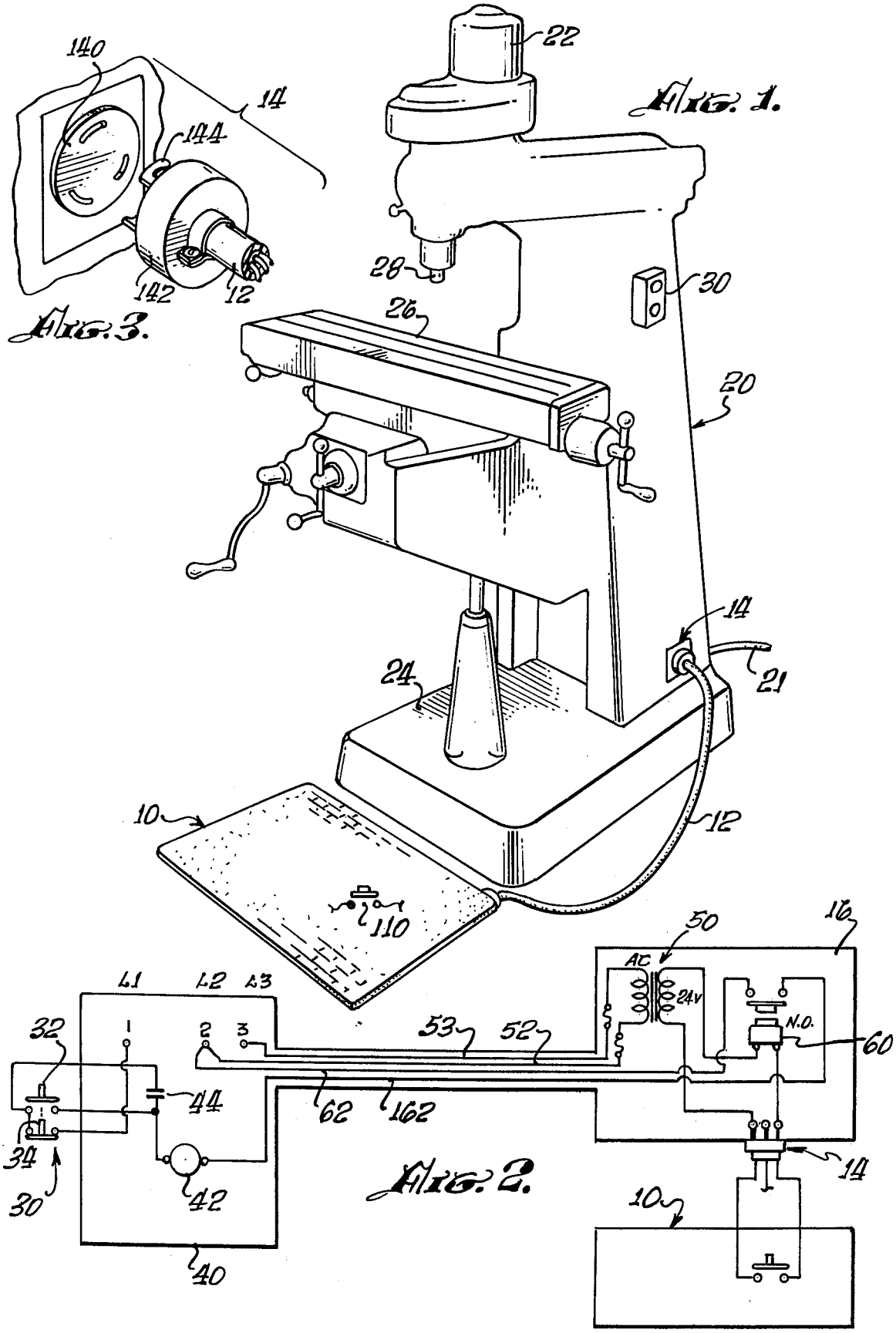
FIG. 1 is a perspective view of a typical milling machine equipped with a safety switch of the invention, in the form of a pressure-sensitive mat switch with a flexible cable, attached to the milling machine by a twist-lock connector.
FIG. 2 is a schematic electrical circuit illustrating the interconnection of the safety mat switch with a typical machine tool power control circuit, employing a magnetic starter for a three-phase motor.
FIG. 3 is a fragmentary view of the cable connector.

The perspective view of FIG. 1 shows a safety mat switch 10 attached to a typical milling machine 20 by means of a flexible cable 12 and a connector 14. The milling machine 20 is built on a base 24, has a movable worktable 26 and a rotating quill 28 driven by an electric motor 22 through a suitable speed-reducing transmission. The motor 22 is powered by a three-phase supply cable 21 and is started and stopped by means of switch 30.

The milling machine 20 may be taken as typical of the machine tools and similar devices in which incoming electrical current is converted into mechanical motion for some useful or productive purpose. The presence of such motion, such as the rotation of the quill 28 in the milling machine of FIG. 1, creates a danger for the operator or for a by-stander, in that some portion of the anatomy or clothing of such a person may become entrained in the moving component and result in damage or injury.

The safety switch 10 is provided with internal switching elements and electrical contacts which may be schematically represented as a 'normally open' switch 110. The exertion of a suitable load onto the surface of the mat results in the closure of the contacts in the switch 110 and the establishment of an electrical circuit through the mat.

The connector 14 is a quick-disconnect, multiple terminal device, generally known as a twist-lock plug and is commonly employed in industrial electrical power cable where high assurance is required that the connection will not be accidentally broken by a tensile load on the cable.

The detailed construction of the connector 14 is illustrated in the fragmentary view of FIG. 3 which shows a plug 142 and a mating socket 140, with the plug attached to the flexible cable 12. The plug body bears three identical contact blades 144 with an integral hook which engages a mating component within the socket 140 upon the insertion of the plug thereinto and the rotation of the plug in a clockwise sense.

After the necessary modifications are made to the control circuitry of the milling machine 20, as evidenced by the installation of the socket 140 into the base of the machine, the user may render the machine inoperable by removing the safety switch 10, or, conversely, put the machine into an operable condition by installing the mat 10 and engaging the plug 142 in the socket.

With the safety switch mat 10 properly connected to the milling machine 20, the latter may be started by an operator pressing the start button of the switch 30, while standing on the mat 10. It should be noted that both of these actions are required, the weight of the operator must be on the mat and the start switch must be depressed, to cause the motor 22 to be supplied with current.

After starting the machine the operator uses it in the manufacture of some artifact in the normal manner. In the event of a malfunction, or the imminence of an accident or dangerous condition the operator may stop the machine in two ways: by depressing the stop button in the switch 30, or by removing his weight from the mat 10. By simply taking a step to the left or the right, or stepping backward, if that is possible under the circumstances, the mat is unloaded and the motor 22 is stopped. In an extreme emergency requiring instantaneous reaction, the operator may just hop into the air for a brief moment, and, thereby, secure a cessation of machine motion.

It can be readily appreciated that the motions required to stop the machine tool 20 by unloading the mat 10 are more instinctive, and easier to perform, than the prior-art requirement of operating the stop switch. The latter requires careful coordinator of body movements, and at least one free hand, commonly the right hand, to depress the button. Stepping away from danger, on the other hand, leaves the hands free and is an automatic response to a dangerous situation.

The presence of the safety mat switch 10 also prevents the operator from succumbing to the temptation of setting his machine into an automatic, or semi-automatic, operating cycle and walking away from it. Unattended machines may be dangerous in themselves, or may become dangerous if not shut down at the appropriate instant by an alert operator. As long as the mat switch 10 is part of the control circuit, the absence of the operator from his work station on the mat will automatically bring the machine to a halt.

Conversely, the mat switch 10 may be utilized as a means for disabling the machine tool to which it is attached. By breaking the connection at the connector 14, and thereby interrupting the current flow path to the coil of the magnetic starter, or to an analogous control system component, the machine tool 20 is rendered inoperable, even though still connected to the normal electrical supply. The circuitry of the safety switch, as discussed in some detail with reference to FIG. 2 below, is set up in such a manner, by preference, that operation of the start button of the switch 30 will not result in any consequent machine movement. It is also possible to arrange the circuitry in such a manner that the start button is not completely disabled, but that the machine operation is restricted to the time period during which the button is physically held in the depressed condition. This latter arrangement may be more suitable to circumstances where the machine tool is frequently readjusted or retooled and where the setupman performing such work requires momentary operation of the machine to check control adjustments.

The schematic circuit diagram of FIG. 2 depicts a typical machine tool control system, including a start-stop switch 30 and a magnetic starter 40 for a three-phase motor, and incorporating a safety mat switch 10 and associated control board 16.

The conventional motor control circuit consists of only the start/stop switch 30 which includes two momentary contact switch buttons, a normally open contact 'start' button, and a normally closed contact 'stop' button, and a magnetic starter with a magnet coil 42 and four normally open sets of contacts. Of the latter, only the contact pair 44 is illustrated, the three switch contacts through which the drive motor 22 is supplied with current have been omitted for the sake of clarity of illustration. The switch 44 is utilized to convert the magnetic starter 40 to a 'latching relay', so that the magnet coil 42 may be supplied with current directly through the contacts 44, as well as through the start button contacts of the switch 30.

The supply of current to the magnet coil 42 from the terminal L1 of the three-phase supply passes through the normally closed contacts of the stop button in switch 30 and, thence, to one side of the normally open start button contacts and to one side of the normally open switch 44. The other sides of the start button contacts and of the contacts of switch 44 are both connected to the same terminal of the coil 42. When the start button is momentarily depressed, current flows through the magnet coil 42, closing the contacts of the switch 44, as well as the contacts of the three line switches to the electric motor 22. Removal of the operators finger from the start button does not de-energize the coil 42, because an alternate current path has been made available through, the now closed, switch 44; the magnetic starter is said to be in a 'latched' condition. The magnet coil may be de-energized by the momentary operation of the stop button in switch 30.

In the modified control circuitry of FIG. 2, the other terminal of the magnet coil is not supplied directly from a phase L2 of the supply cable, as would be the case in the conventional machine circuit, but has a relay operated switch 60 interposed between the supply and the coil. The contacts of the switch 60 are normally open and will close only when the associated relay coil is energized by a circuit incorporating the switch 110 of the safety mat 10.

To reduce the shock hazard which may ensue upon the exposure of the internal conductors of the safety mat switch 10 through mechanical damage, the conductors through the switch 110 carry a reduced potential, attained by the interposition of transformer 50 into the control circuit. The transformer 50 is suitably fed, on the upstream side, from terminals L2 and L3 of the machine supply, through conductors 52 and 53, respectively. The contacts of the relay-operated switch 60 are connected to the phase L2 by means of a conductor 62, and to the other terminal of coil 42 through a conductor 162.

The use of all three of the supply phases in the control circuit ensures that the main switch contacts of the magnetic starter 40 will open upon the failure of any one of the three phases therethrough — as for example by the opening of a fuse or circuit breaker in the line. The loss of either phase L1 or L2 will directly de-energize the coil 42, while the loss of phase L3 will de-energize the safety mat switch 10 through a failure of the low-voltage current supply through the transformer 50.

As is readily apparent from the circuit diagram of FIG. 2, the installation of the safety mat switch requires only the attachment of four conductors to terminals already available within the magnetic starter 40, and the removal of a single conductor, originally interconnecting L2 with the coil 42.

An alternate embodiment of the safety circuit of the invention interposes the switch 60 into the circuit of the switch 44, placing the normally open switches into a series configuration in the L1 supply to the coil 42. This will permit the operation of the starter 40 through the start button of switch 30, but not permit the latching of the starter coil 42 unless the safety switch mat 10 is connected to the machine and subjected to the weight of the operator.

The use and construction of the safety mat switch, and of the associated electrical circuits, has been described above with reference to a preferred embodiment. Once exposed to the teachings of the disclosure, those skilled in the art of constructing control circuits for electrically operated and/or controlled machinery will be enabled to develop modifications in the embodiment disclosed. Such modifications, substitutions and changes shall be deemed to be encompassed by the disclosure of the invention, the invention being delimited only by the appended claims.

In particular such changes shall be deemed to include the application of the safety mat switch to all types of machine tools and to other power-operated machinery in which it is desirable or required to ensure the presence of an operator adjacent to the machine, or in which it required to signal the presence of such an operator without imposing upon him the duty of physically operating a control device. The invention shall also be applicable to machinery where the primary power source is not derived from an electrical circuit, but where the control of the application of such power, hydraulic or otherwise, can be attained through an electrically operated servomechanism, incorporating a safety switch of the invention.

The inventor claims:

1. A safety device for a machine equipped with an electrically operated primary controller for the prime mover thereof, comprising:

a mat switch, including electrical switching elements reciprocable between an open and a closed position, with said closed position attained upon the sensing of the weight of an operator on the mat, and the open position regained upon the removal of such weight, quick-disconnect connector means, with a socket affixed to said machine and a plug electrically interconnected with said switching elements by means of insulated conductors passing through a flexible cable, a source of low-voltage electrical current, a relay-operated, normally open, control switch, with the coil thereof electrically interconnected with said source through said connector means and said mat switch, and conductor means, operatively interconnecting said primary controller with the normally open switch contacts of said control switch, whereby said primary controller is energized while the switching elements of said mat switch remain in the closed condition during the presence of the operator on the mat, with said socket and said plug conductively engaged in said connector means.

2. The safety device of claim 1, wherein:

said primary controller is a magnetic starter.

3. The safety device of claim 1, wherein:

said source of low-voltage electrical current is a transformer.

4. The safety device of claim 3, wherein:

said transformer supplies current at approximately 24 volts to the coil of said control switch.

5. The safety device of claim 1, wherein:

said connector means comprises a twist-lock plug and mating socket.

6. The safety device of claim 2, wherein:

said prime mover is an electric motor.

7. The safety device of claim 6, wherein:

said electric motor is operated from a three-phase supply.

8. The safety device of claim 1, wherein:

said machine is a milling machine.

* * * * *